US005749811A

United States Patent [19]

Wilson

[11] Patent Number: 5,749,811

[45] Date of Patent: May 12, 1998

[54] SKIING SIMULATOR

[76] Inventor: Roger F. Wilson, 1923 Wood Hollow La., Sarasota, Fla. 34235

[21] Appl. No.: 334,346

[22] Filed: Nov. 2, 1994

[51] Int. Cl.[6] ..... A63B 69/18

[52] U.S. Cl. ..... 482/71; 434/253

[58] Field of Search ..... 482/71, 51, 70, 482/54, 114–115, 146; 434/253

[56] References Cited

U.S. PATENT DOCUMENTS

| | | | |
|---|---|---|---|
| 1,064,968 | 6/1913 | Hagen | 482/54 |
| 2,573,808 | 11/1951 | Ravoire . | |
| 3,524,641 | 8/1970 | Ossenkop . | |
| 3,547,434 | 12/1970 | Ossenkop . | |
| 3,834,693 | 9/1974 | Poppenberger . | |
| 3,912,260 | 10/1975 | Rice | 482/71 |
| 3,941,377 | 3/1976 | Lie . | |
| 4,544,153 | 10/1985 | Babcock | 482/71 |
| 4,607,839 | 8/1986 | Knudson | 482/71 |
| 4,743,014 | 5/1988 | Loane . | |
| 4,744,557 | 5/1988 | Smirmaul . | |
| 4,744,558 | 5/1988 | Smirmaul . | |
| 4,869,496 | 9/1989 | Colombo | 482/71 |
| 5,020,793 | 6/1991 | Loane . | |
| 5,147,257 | 9/1992 | Loane . | |
| 5,203,751 | 4/1993 | Chang . | |
| 5,284,461 | 2/1994 | Wilkinson et al. . | |
| 5,304,106 | 4/1994 | Gresko . | |
| 5,399,140 | 3/1995 | Klippel | 482/71 |

FOREIGN PATENT DOCUMENTS

| | | |
|---|---|---|
| 632029 | 12/1961 | Canada . |
| 2224798 | 11/1973 | Germany . |
| 2515570 (A1) | 10/1976 | Germany . |
| 3916638 | 11/1990 | Germany . |
| 673092 (A5) | 2/1990 | Switzerland . |
| 1475694 | 3/1987 | U.S.S.R. . |
| 1493272 | 7/1989 | U.S.S.R. . |
| 1533-710-A | 1/1990 | U.S.S.R. . |
| 1655526 (A1) | 6/1991 | U.S.S.R. . |

OTHER PUBLICATIONS

Nordic Track, *Nordicsport Downhill* advertisement, ©1993.

Nordic Track, *Skiing* advertisement, p. 191, 9–1992.

Skier's Edge, *Skiing Magazine* advertisement, ©1994.

*Primary Examiner*—Stephen R. Crow

*Attorney, Agent, or Firm*—Armstrong, Westerman, Hattori, McLeland & Naughton

[57] ABSTRACT

A ski simulation device for providing training and/or exercise includes a support frame, a track mounted on the support frame, and a pair of foot platforms supported on the track. The foot platforms are each independently slidably supported on track cars which slide along the track. The foot platforms are also independently rotatable around a generally vertical axis on the track and are each independently rotatable around a horizontal axis to enable edging, etc. The track is rotatably supported on the support frame in a pivot bushing at an inclined angle for rotation about the inclined angle. This enables the track to rotate when one's weight is at one side thereof. In addition, the support frame is flexibly mounted on a floor frame via flexible mounts which enable tilting, flexibility, etc., so as to greater simulate actual skiing.

21 Claims, 9 Drawing Sheets

10
50
1
1T
1B
51'
10T
10B 90
52
53
58'
58
90
82
81
3
50
51
58
5
10
4
1
2

Fig.14
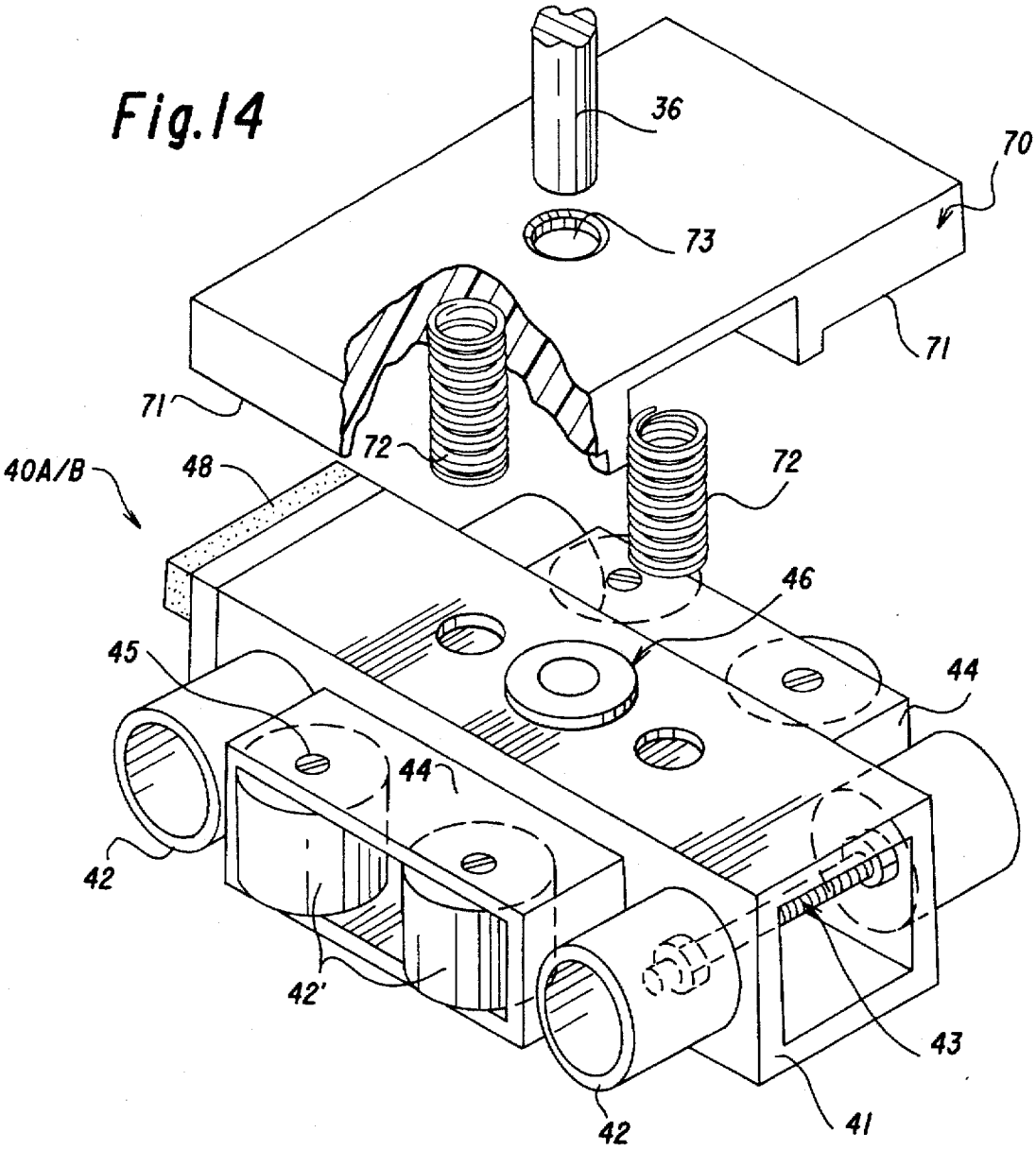
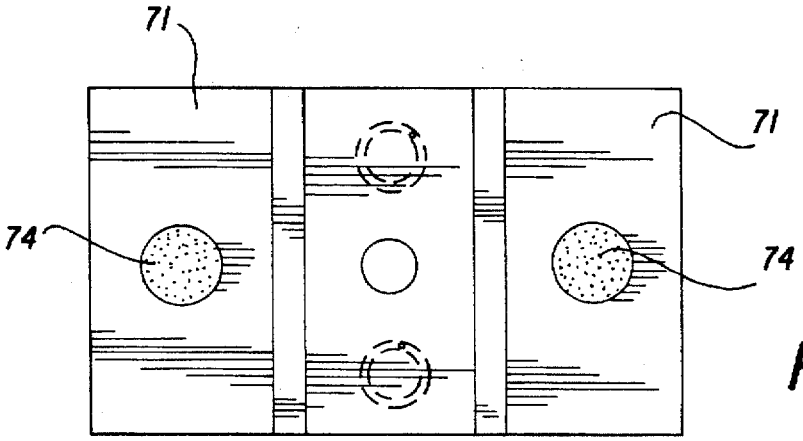
Fig.15

SKIING SIMULATOR

BACKGROUND OF THE INVENTION

A. Field Of The Invention:

This invention relates generally to skiing simulation devices and, more particularly, to training and exercising equipment for simulating muscle and aerobic activity during skiing, such as Alpine and downhill skiing.

Skiing is often referred to as an non-instinctive sport. Accordingly, the advancement of skiing skills involves a continuous repetition of proper form.

Because most geographic areas have a small season in which skiing is available, and because it is time consuming and expensive to ski at most ski slopes even during the skiing season when skiing is available, there has been, and prior to the instant invention, remained an unfulfilled need for a moderately priced device that allows skiers to properly prepare for skiing off of the ski slopes—such as (a) at indoor skiing classes, (b) at recreational centers, and (c) at home.

B. The Related Art:

A few skiing simulation devices are known in the art. However, these few machines are very limited and don't properly permit simulation of alpine or downhill skiing.

In general, these devices are mostly focused on providing an aerobic exercise rather than improving skiing skills. As an example, some of the other devices incorporate a large elastic band to facilitate motion which greatly distracts from realistic skiing simulation.

SUMMARY OF THE INVENTION

In view of the unfulfilled need for an accurate downhill skiing simulation device and in view of the limitations in the existing devices, the present, high accuracy, skiing simulation device was developed.

A primary object of this invention is to provide a skiing simulation device which more accurately simulates the motions performed during skiing conditions.

Another object of this invention is to provide such a skiing simulation device that is appropriate for a broad range of skier's—from the expert skier to the beginner skier, or novice.

Another object of this invention is to provide an exercise device which accurately simulates muscle, aerobic, and balancing activities during such skiing conditions.

According to one aspect of the invention, a ski simulation device is provided which includes a support frame; a track mounted on the support frame and rotatable on the support frame about an inclined axis; and at least one foot platform for a user's foot supported on the track.

According to a further aspect of the invention, the support frame is flexibly mounted on a floor frame, and the support frame includes a pivot around which the track is rotatable.

According to a further aspect of the invention, there are two foot platforms and the foot platforms are independently slidably supported on the track via track cars slidable along the track.

According to a further aspect of the invention, the foot platforms are independently rotatable around a generally horizontal axis on said track cars.

According to a further aspect of the invention, the foot platforms are independently rotatable around a generally vertical axis on said track cars.

The present device, unlike the other related devices, allows simulation of virtually all of the essential motions in skiing including downhill and Alpine skiing. The present invention enables one to obtain (a) technique training, (b) aerobic exercise, (c) specific muscle strengthening/training, and (d) balance exercise/training—all while having fun and exercise in practicing skiing. Thus, the present invention can be used to provide a program sufficient to maintain the interest and enthusiasm of even an advanced skier.

The present device achieves a highly sophisticated skiing simulation in a relatively simple and inexpensive mechanism which was developed through careful innovation and design. The structure of the present design can provide a freedom of action and movement that encourages proper form, while not forcing form. The present invention maintains a balance between the machines ease of use for lower skill levels while allowing for the implementation of more advanced skills. The present device's forgiving realistic simulation helps skiers identify and develop areas in their form that may need improvement.

The broad range of motions available on the present device makes it an ideal trainer/exerciser simulator for all levels of ability. From those who have never skied to black diamond experts, this device facilitates progressive advancement to higher levels of skill and technique. Even further, this device could also greatly assist training of blind skiers.

Notably, the present device is driven by the skier and gravity, as in actual skiing, and not a combination of the skier and a large elastic band as found in other devices. This translates into a much greater control for the skier over the type and timing of turns, etc. The skier is able to hold a position, or turn, for however long he desires to. As a result, this not only provides for the possibility of mixing different types of turns, but it also allows the skier time to concentrate fully on technique, positioning, and action. The skier does not have to concentrate on responding to contraction of an outstretched elastic band.

Because it can be a skier driven device, the present device naturally provides a great exercise workout. The use of damping devices (springs, etc.) in the present device does not greatly affect motion of the user, but only works indirectly to enhance realism. The foot platform, platform supporting bracket, and track car assemblies can remain free and independent, and in no way connected to such devices.

As stated, the present ski device allows for and encourages the development of proper skiing technique and provides aerobic exercise and muscle strengthening. For example, the present device's unique configuration strongly encourages the primary weighing of the outside ski. (Note: The outside ski is defined as the ski covering a larger radius arc during a turn). This is accomplished by simulating the instability a lower level skier would experience on the ski slopes when trying to balance on (or weight) the inside ski. During the process of bringing the inside track car/foot platform assembly near or together with the like outside assembly, until it bears against an end stop or the outside track car/platform assembly, it offers little initial lateral stability if one tries to rely on it to catch his balance. In such cases, as when on a ski slope, one often ends up in a split stance or toppling into the inside of the turn and, when using the present device, one perhaps may have to step off of the device to regain his balance. The realistic simulation, therefore, demands a proper development of very important techniques for carving turns.

As a teaching tool, the present device is unsurpassed, for beginners and experienced skiers, alike. It is as equally proficient in helping new skiers begin to develop a feel for skiing, and in learning the important basic fundamentals required on the slopes, as it is in helping experienced skiers improve and strengthen their form, providing all levels a greater enjoyment and confidence on the slope.

BRIEF DESCRIPTION OF THE DRAWINGS

The present invention is illustrated by way of example and not limitation in the accompanying drawings, in which like references indicate like parts, and in which:

FIG. 14 is an enlarged top perspective exploded view of a track car and braking plate of the preferred embodiment of the invention shown in FIG. 1;

FIG. 15 is a bottom view of the braking plate of the preferred embodiment shown in FIG. 1;

DETAILED DESCRIPTION OF THE PREFERRED EMBODIMENTS

Figure 1:
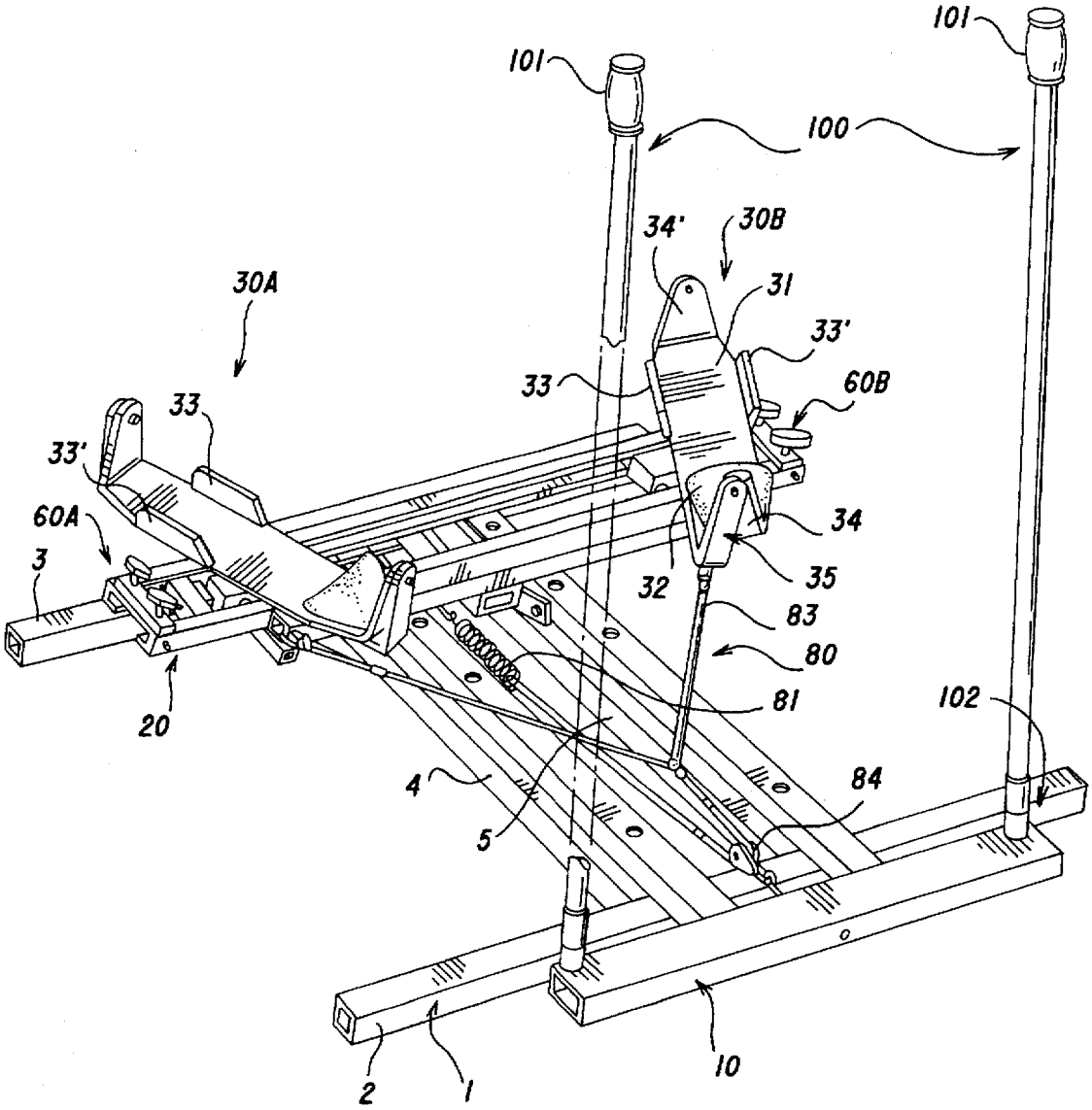
FIG. 1 is a top perspective view of a preferred embodiment of the invention.
Figures 7, 8:
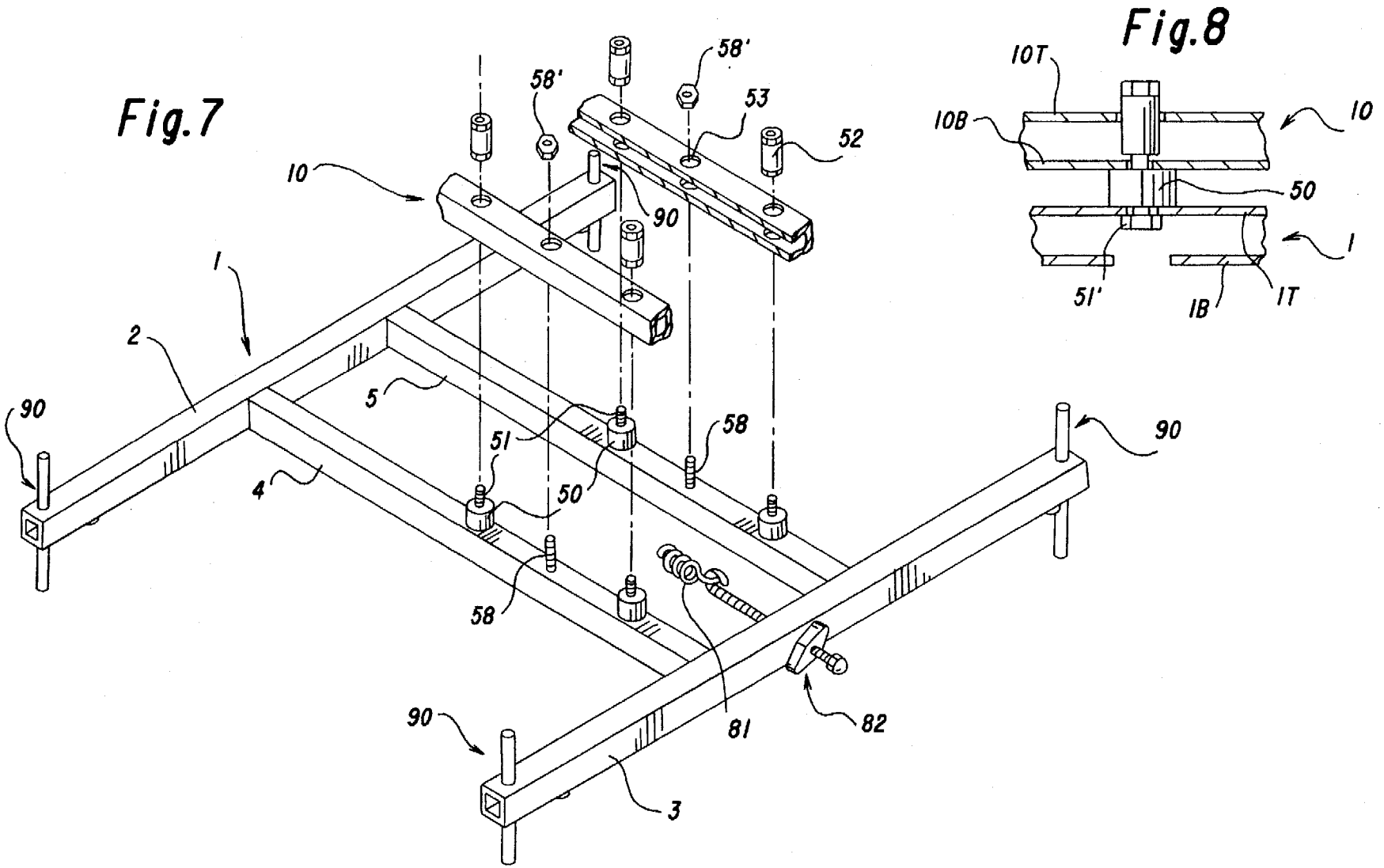
FIG. 7 is an exploded top perspective view of the connection between the center frame and the floor frame of the preferred embodiment shown in FIG. 1.
FIG. 8 is a side view, partly in section, of the connection between the center frame and the floor frame of the preferred embodiment shown in FIG. 1.
Figure 13:
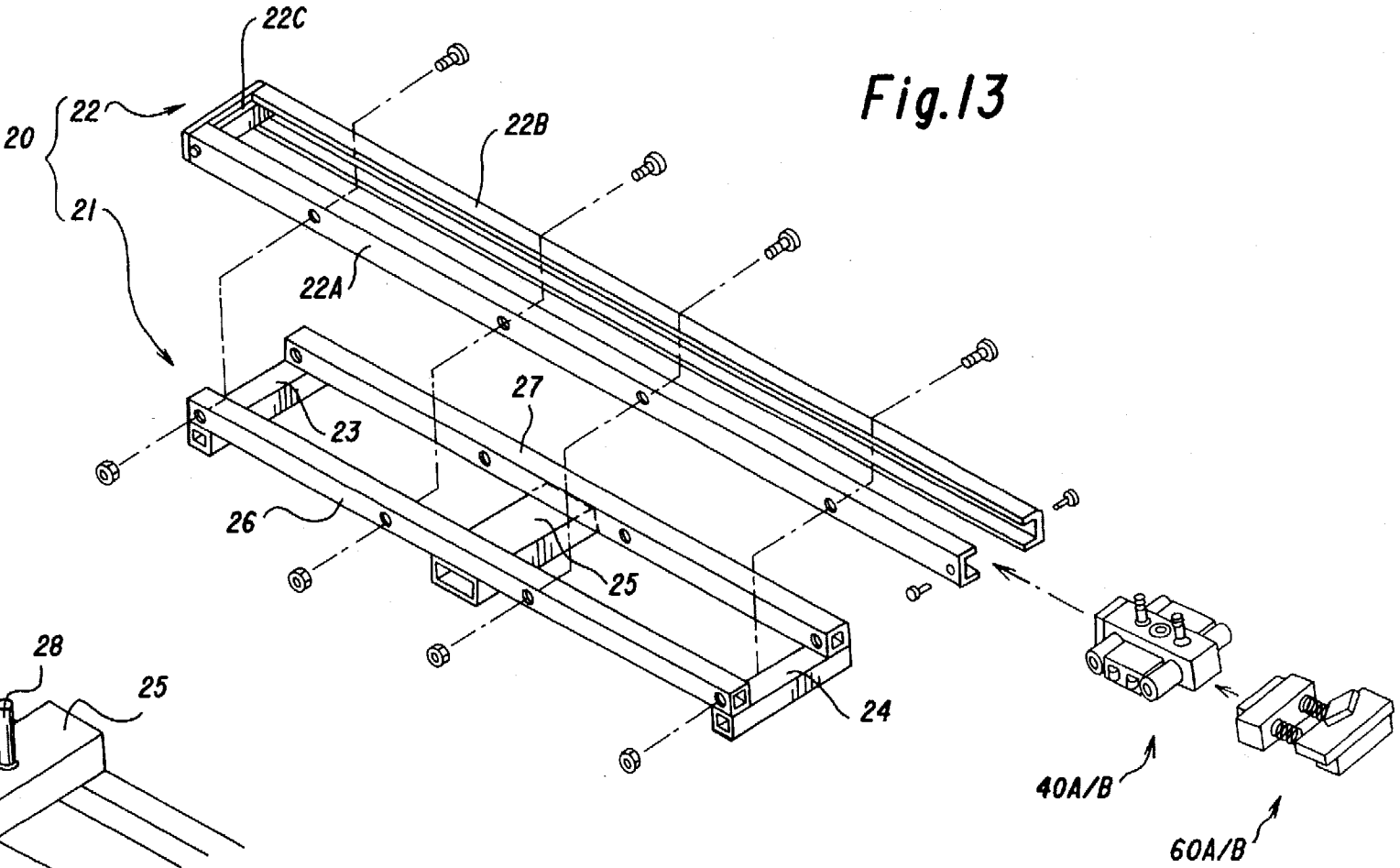
FIG. 13 is a top plan exploded view of the pivoted support frame, track, track cars, and spring loaded track end stops of the preferred embodiment of the invention shown in FIG. 1.

As shown in FIG. 1, the preferred embodiment of the present invention incorporates, in brief: a floor frame 1; a center frame 10 supported via rubber mounts 50, FIG. 7, on top of the floor frame 1; a transverse track 20 pivotally supported at the rear of the center frame 10 so as to pivot around a generally vertical, forwardly inclined, axis; and two foot platforms 30A, 30B each pivotally supported on slidable track cars 40A, 40B, FIG. 13, which independently and freely move laterally along the transverse track 20.

Figure 2:
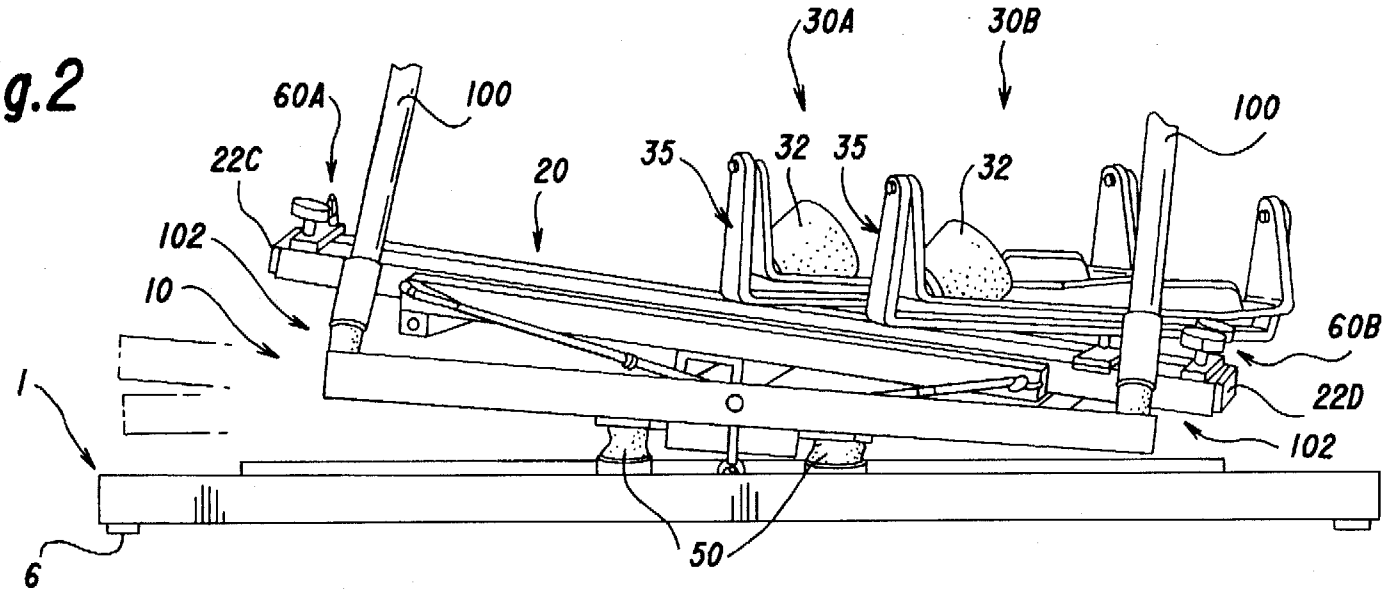
FIG. 2 is a front side view of the first embodiment shown in FIG. 1.
Figure 4:
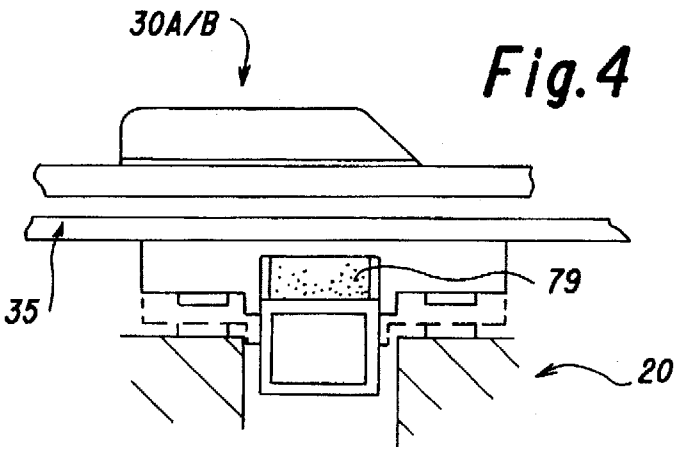
FIG. 4 is a side view of a modified weight activated type braking device for use in the device of FIGS. 1 and 2.
Figure 3:
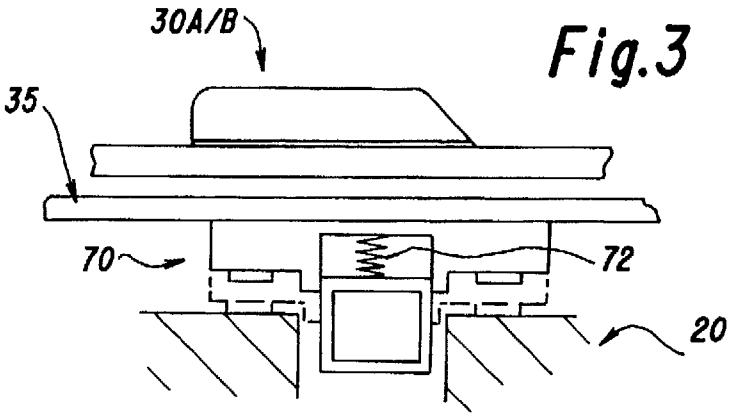
FIG. 3 is a side view of a weight activated momentary type braking device of the embodiment of FIGS. 1 and 2.
Figure 19:
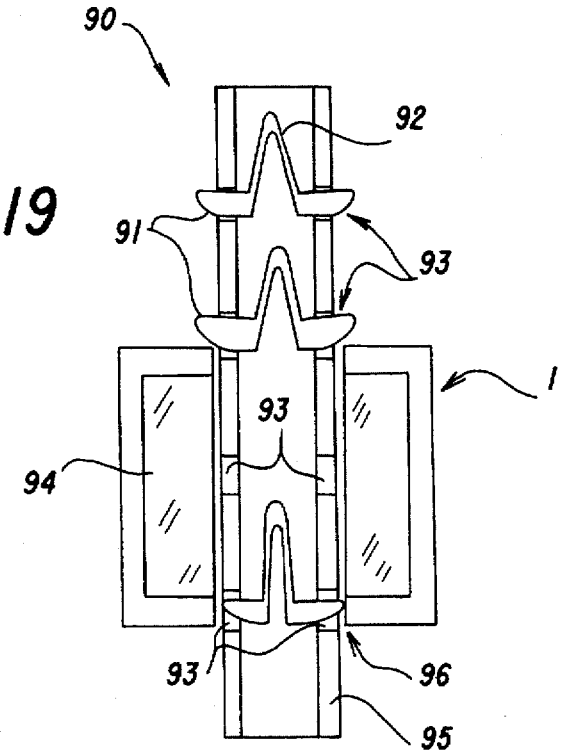
FIG. 19 is a cross sectional view of a height adjustment mechanism according to one preferred embodiment of the invention.

The floor frame 1 includes two parallel front and rear beams 2 and 3, respectively, and two parallel right and left side beams 4 and 5, respectively, FIG. 7. As shown, the front and rear beams 2 and 3 extend a sufficient distance to the sides of the device to enhance stability. The left and right side beams extend, in the preferred construction, generally parallel to one another and generally close to, or adjacent to one another. As shown in FIGS. 2, 7 and 19, the floor frame 1 can include foot pads 6 or adjustable pads 90 for anti slip, floor protection, etc., preferably located at the ends of the front and rear beams as shown.

Figure 10:
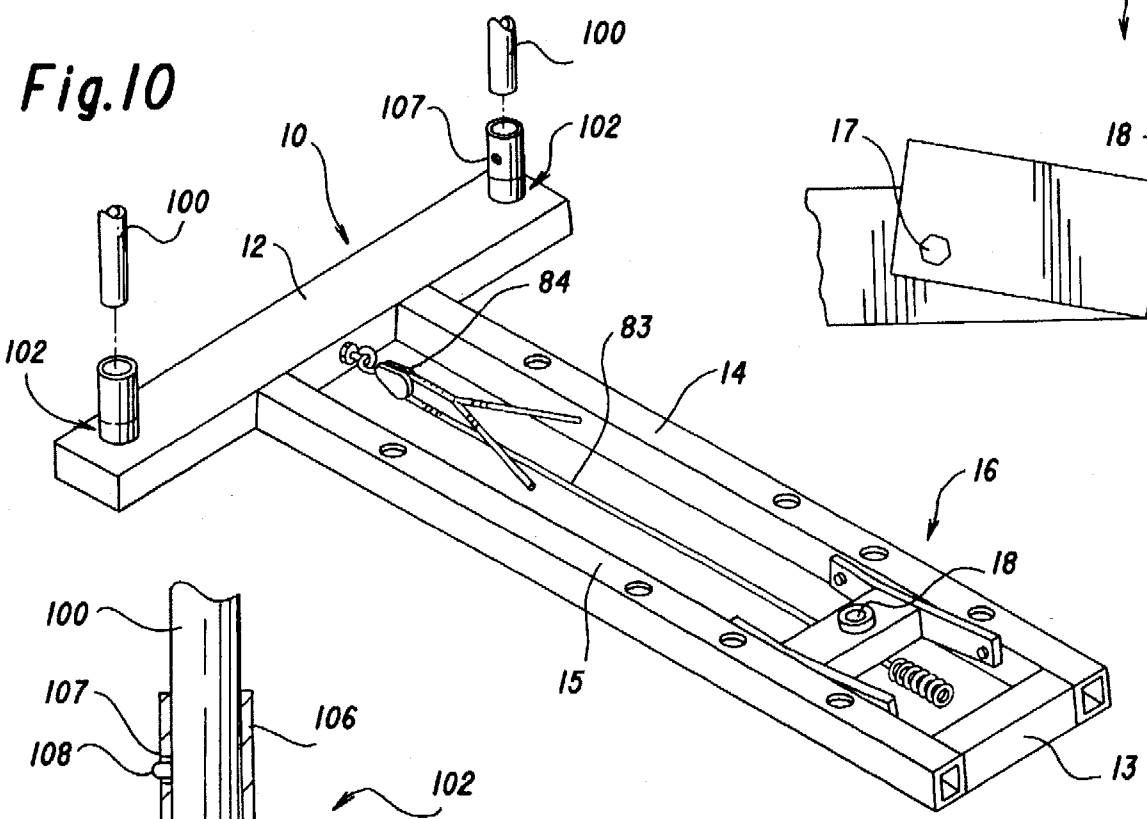
FIG. 10 is a top perspective view of the center frame structure of the preferred embodiment shown in FIG. 1.

The center frame 10, FIGS. 1 and 10, similarly includes two parallel front and rear beams 12 and 13, respectively, FIG. 10, and two parallel right and left side beams 14 and 15, respectively.

Figure 11:
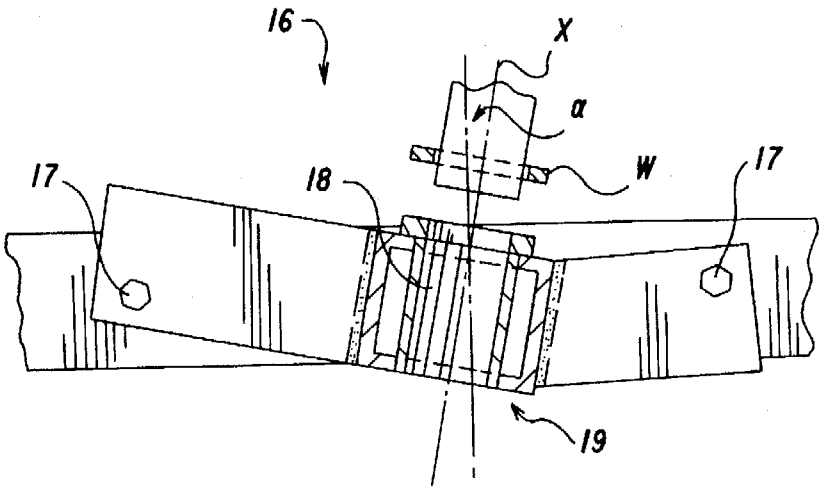
FIG. 11 is a side view, partly in section, of the pivot bushing connected to the center frame shown in FIG. 10.

As shown in FIGS. 10 and 11, a pivot bracket 16 is fixedly mounted via bolts 17, or other appropriate means, to the center frame 10. The pivot bracket 16 includes a pivot bushing 19 having a pivot hole 18 which extends at a forward angle of inclination, FIG. 11.

Figure 12:
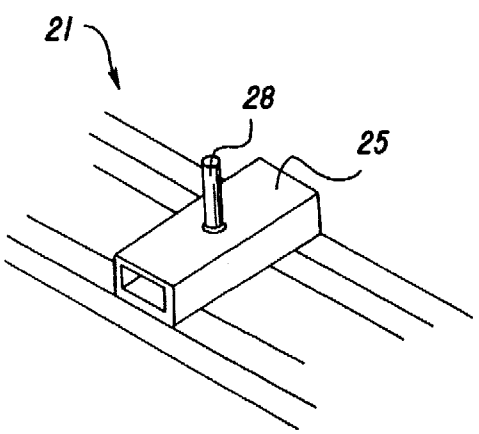
FIG. 12 is a bottom perspective view of the pivoted support frame of the preferred embodiment of the invention shown in FIG. 1.

As shown in FIG. 1, the transverse track 20 is mounted on top of the center frame 10. As shown in FIG. 13, the track 20 includes a pivoted support frame 21 and a channel assembly 22. The pivoted support frame includes: two short right and left side end beams, 23 and 24, respectively; a wide central support beam 25; and forward and rearward transverse beams 26 and 27, respectively. As shown in FIG. 12, the wide central support beam includes a pivot pin 28 fixedly mounted to and extending generally perpendicular from the bottom thereof.

As shown in FIG. 13, the channel assembly 22 includes forward and rearward transverse beams 22A and 22B, respectively. Beams 22A and 22B are generally U-shaped and facing one another so as to create a receiving channel therebetween. As illustrated in FIG. 13, the receiving channel accommodates therein: two slidable track cars 40A, 40B as well as two spring loaded track end stops 60A and 60B, the latter being located outside of each of the track cars at either end so as to limit the outward movement thereof (discussed below). The beams 22A and 22B are also connected at their outer ends via connecting members 22C and 22D, respectively (22D is illustrated in FIG. 2).

The specific structure of the track cars 40A, 40B, according to the preferred embodiment of the invention, is shown in FIGS. 14 and 15. As shown, the track cars include: a track car body 41 and eight (8) friction reducing wheels 42, 42'. Four (4) of the wheels 42 supporting a generally vertical load/force (rotating around a horizontal axis), and four (4) of the wheels 42' supporting a generally horizontal load/force (rotating around a vertical axis). As shown, the wheels 42 are preferably mounted via a bolt/nut connector 43 to the track car body 41. The wheels 42' are preferably mounted in extension housings 44, such as by similar bolts, etc., 45.

The wheels preferably provide sufficient friction reduction such that the cars move with very little resistance in order that one does not feel nor is hindered by more then a minimal resistance when moving from one side of the machine to the other. Because snow is not generally sticky, this helps to approximate natural conditions. Although not illustrated in the Figs., the wheels are preferably provided with ball bearings to facilitate rotation thereof.

The two independent track cars, thus, support the foot platforms and bracket assemblies (discussed below). And, as noted, the wheels facilitate easy movement of the foot assemblies along the generally transverse track, which is preferably straight.

As shown in FIG. 14, the track cars 40A, 40B can include a protective member 48 on a side thereof to protect one track car if abutted against the adjacent track car. If desired, such a protective member 48 could also be applied to help reduce impact of the track cars with the track end stops 60A, 60B (discussed below). The protective member 48 could be made of a suitable foam, rubber, resin or the like.

As noted, in order to securely fix the cars to the track, the track is configured so as to captivate the cars and to keep them in position along the track even when the loading is off center. Although the load on the cars is always generally downward, pressing with one's heel or toe on the foot platform causes the car to lift up on the opposite side within the captivating receiving channel.

Figure 5:
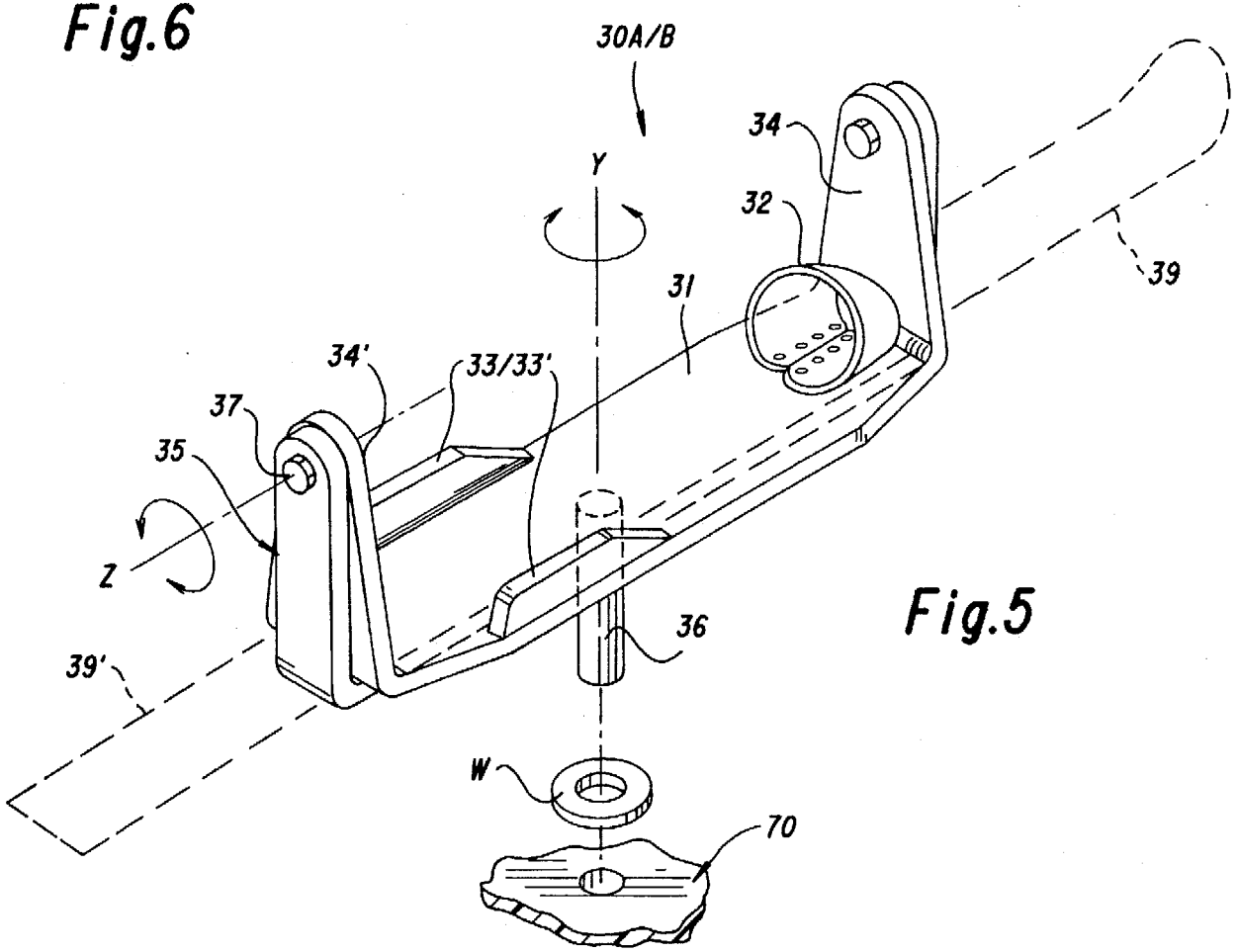
FIG. 5 is an enlarged top perspective view of a foot platform of the preferred embodiment shown in FIG. 1.
Figure 6:
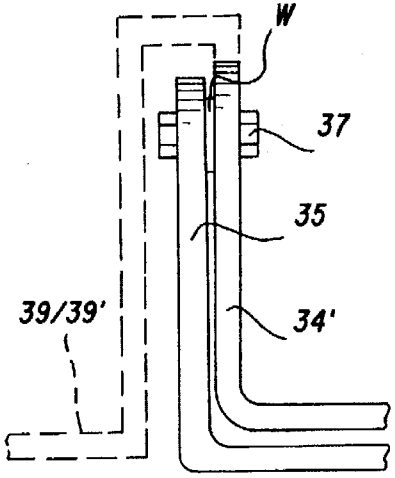
FIG. 6 is side view of the pivot connection of the foot platform shown in FIG. 5.

As best seen in FIGS. 1, 5 and 6, the foot platforms 30A, 30B each include: (a) a pivoting foot support surface 31 having a toe hold 32 mounted on the forward side thereof for receiving the tip of one's foot or shoe; (b) upstanding medial and lateral side foot support flanges 33, 33', respectively; and (c) upstanding toe and heel plates 34, 34', respectively. As illustrated, the toe and heel plates 34, 34' are pivotally supported near their upper ends to a foot platform support bracket 35 via pivots 37 so as to rotate around the generally horizontal axis Z, FIG. 5. The horizontal pivot 37 for the platform is located above the foot platform to provide greater initial stability. Further, in order to reduce friction, a washer W can be placed between the bracket 35 and the foot platform portions 34, 34', FIG. 6.

The foot platform support bracket 35 is generally U-shaped and has a pivot rod 36 extending generally from the middle thereof generally perpendicularly downward from the base thereof.

As shown in FIG. 14, the pivot rod 36 extends into a bushing 46 in the track car body 41. In this manner, the foot platforms 30A and 30B are each independently rotatable and horizontally slidable along the track 20, FIG. 13. To facilitate rotation, the bushing/pivot rod engagement can include friction reduction means, such as oil and/or ball bearings, etc. Further, in order to reduce friction, a washer W can be placed between the bracket 35 and the track car 40A, 40B and/or brake 70 therebelow, FIG. 5.

As illustrated in FIGS. 3, 4, 14 and 15, in the preferred embodiment, the present invention also contemplates the use of weight activated momentary type brakes.

As so shown, a brake plate 70, FIG. 14, is located between the car/track assemblies and the foot platform/bracket assemblies. The brake plate has lower contact portions 71 arranged to press against the top of the track 20 when a certain pressure is applied to the foot platforms 30A,B.

The brakes are constructed such that when downward pressure is released, springs 72 lift the brake away from the track surface. Although such springs are included in the preferred embodiment, it should be apparent that any appropriate biasing means could be used, i.e. any configuration that results in the same biasing so as to avoid unnecessary or unwanted drag—for example, resilient pads 79, FIG. 4, can be used.

As shown, the springs 72 are preferably coil springs which extend between the brake plate 70 and the track car body 41 so as to bias the brake plate 70 upwardly therefrom. As shown in FIG. 15, the lower surfaces 71 of the brake plate may use braking pads 74 to facilitate braking action.

Nevertheless, in the most preferred construction, a biasing means for lifting the brake away from the track is not utilized. In the most preferred construction, only a little friction is provided when the brake is allowed to freely rest upon the track. Thus, the brake will properly apply a braking force only when a pressure which is more than a minimal pressure is applied to it. One skilled in the art would recognize that the desired friction relates to the materials used, the surface areas and textures, weight, etc. For example, the brake plate 70 can be made of a plastic or synthetic resin material and the channel assembly 22 can be made of a suitable metal.

As shown in FIG. 14, the brake plate 70 has a through hole 73 for receiving the pivot rod 36. With the present configuration, the brake works best when pressure is applied in a direction generally perpendicular to the foot support surface 31, i.e. downward or generally axially along the foot assembly pivot pin 36 since the pivot rod 36 needs to move down slightly to effect braking. This is because when downward pressure is applied indirectly, or coming more at an angle from one side, the pivot rod will bind a bit (not shown) in the bushing 46.

In the preferred configuration, the bushing 46 is located centrally and in a vertical orientation in the track car so as to accept the pivot rod 36 of the platform bracket.

According to the preferred embodiment, as illustrated, the brakes are removable. Thus, after an initial and/or adequate adjustment/learning period, the brakes can easily be removed from the cars to allow use of the device with greater freedom of motion and enhanced simulation.

Figure 17:
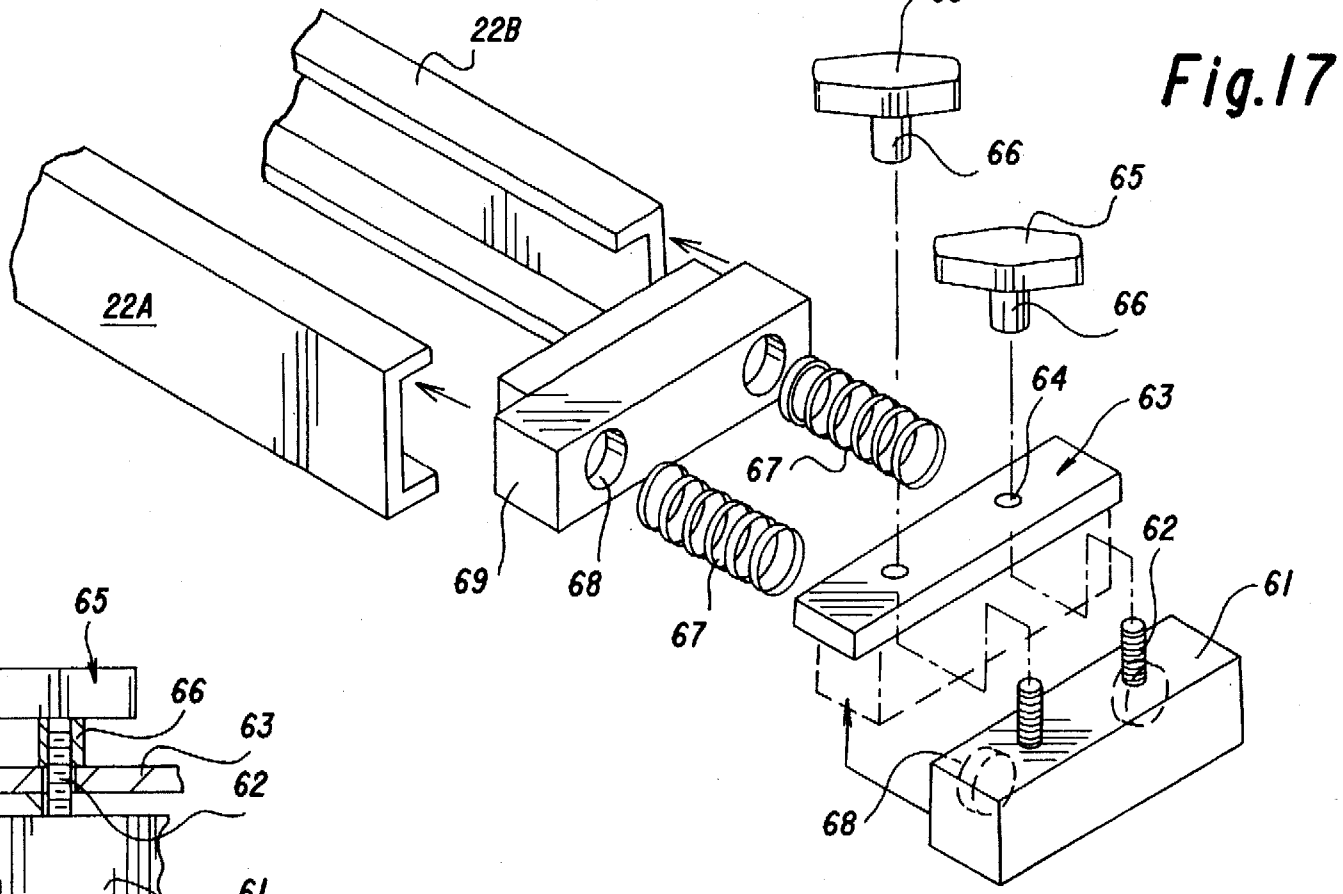
FIG. 17 is a top exploded perspective view of the spring loaded track end stop and the track of the preferred embodiment of the invention shown in FIG. 1.
Figure 16:
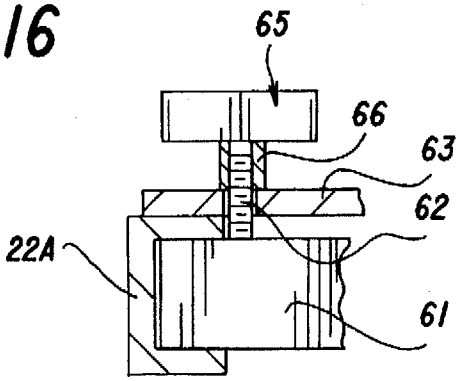
FIG. 16 is a side view shown partly in section of a portion of a spring loaded track end stop in a connected state within the track, of the preferred embodiment of the invention shown in FIG. 1.

As shown in FIG. 1, in the preferred construction, two spring loaded track end stops 60A, 60B are provided for limiting the transverse movement of the track cars 41A, 41B. As best shown in FIGS. 16–17, each of the track end stops 60A, 60B preferably includes: a main body 61 having upwardly extending threaded projections 62; a clamping plate 63 having through holes sized to receive the projections 62; rotatable knobs 65 having downwardly extending shank portions 66 which include a central threaded bore for threadingly engaging the projections 62; coil springs 67 extending between the main body 61 and a spring biased movable stop member 69, the springs being supported on the stop member 69 and the main body 61 receiving the ends of springs 67 within recesses 68. The spring loaded track end stops 60 clamp to the channel assembly 22, FIG. 13, by rotating the knobs 65 such that the clamping plate and the main body fixedly engage the channel assembly. The stop member 69 is sized to freely slide within the channel assembly 22 so that an adjacent track car can slide thereagainst and press the stop member inward against the bias of the springs 67.

Thus, the spring loaded track end stops are easily repositioned and locked, allowing for variable locations from the track ends and/or track center. Placement of the stops closer together toward the center further limits the travel of the track cars, thereby reducing the difficulty level which is, of course, beneficial for beginning users and/or low level skiers and experienced skiers first using the simulator device. Accordingly, the stops can be progressively moved outward as one's skill improves and/or as greater motion is required.

It will be recognized that other means to soften the impact of the track cars/foot platform assembly against the end stops could be utilized—for example, rather than incorporating coil springs as described above, an elastic material can be used, e.g. rubber or the like.

According to the preferred embodiment, as discussed, a track pivot 19 FIG. 11 having a pivot hole 18 with a pivot axis x is formed in the pivot bracket 16. As discussed, the pivot hole 18 is formed generally perpendicular to the pivot bracket, but at a forward angle of inclination α.

Among other things, this feature adds to the realism of the device in that as one's foot is pivoted from the straight forward position (where one's foot is generally parallel to the beams 14 and 15 of the center frame 10 FIG. 10) to a more transverse position, the foot platform becomes increasingly level, which corresponds to action on the ski slope. That is, one's ski's extend more horizontally when one crosses a ski slope at an angle rather than going straight down the slope.

The angle α of the track axis x, shown in FIG. 11, is not extremely critical. When the axis is made more vertical, the rotational force developed is decreased, and the toe below heel effect is reduced (and vice versa). A very great angle may affect form and balance in the fore and aft plane, but this could be interesting for higher skill levels.

In a preferred embodiment, an angle of about 10 degrees can be used, which is suitable for a range of skill. Users with higher skill levels could do well with 15, 25 or more degrees.

A differing, or variable, inclination can also be provided by including an adjustment means which varies the inclination level.

One type of inclination adjustment means 90 is shown in FIGS. 7 and 19. As shown, the floor frame can be provided with through holes 96 which receive legs 95 therein. The legs 95, FIG. 19, each have a hollow center and a plurality of opposing pins 91 which are biased outward by bent springs 92 so as to extend through holes 93 in the legs 95. For description purposes only, one leg 95 is illustrated in FIG. 19. As should be apparent, the beams of the floor frame are preferably made hollow so as to reduce the weight of the structure. Thus, a filler member 94, FIG. 19, can be inserted therein such that the pins do not become stuck inside of the beam. The pins can be positioned below the lower surface of the beam to support the device (such position not illustrated). Although the described adjustment means may be preferable, any height adjustment means could be utilized, e.g. each leg could use a single threaded pin for adjustments in each position. It should be readily apparent to one skilled in the art how to construct such an adjustment means based on the above.

An important feature in the present invention is the rotation of the track 20, FIG. 1, upon the center frame 10. The fact that the track rotates about a central forward angled axis provides two essential results.

First, as noted, when the foot platforms point forward, there is a downwardly pointing toe-below-heel orientation that simulates a modest ski slope.

Second, although this toe below heel orientation described above could potentially be realized without providing an inclination of the track, it is noted that, this forward inclination of the track also has a very significant and important affect on the movement of the track. Specifically, the track tends to rotate about it's inclined vertical axis whenever there is a bias of weight on either side of the inclined center axis of rotation. This results in the sensation that one's foot/feet move forward, as down a ski slope, as one slides and places weight on one (or possibly both) of the foot platforms at one side of the inclined vertical axis. Thus, the present device greatly enhances realism.

Accordingly, the present invention very accurately approximates the making of turns down a ski slope; the forward movement describes an arc and provides for a turning sensation due to the rotation of the track about the inclined central axis. For a given weight, the greater the distance is from the center of the inclined center axis, the greater is the rotation force. This is due to the greater moment arm length between the point of weight applied on the foot platform(s) and the center axis. The range of rotation provided is not critical. However, it should allow for a fair amount of movement in order not to feel restrictive and, thereby, causing any adverse affects. It can also be noted that the precise location of the central axis in the forward/rearward direction (i.e. fore and aft across the width of the track) is not extremely critical, provided that it is not so far away as to remove the sensation provided in the present embodiment. However, in the preferred embodiment it is centered.

To facilitate rotation of the track, the bushing/pivot rod engagement, FIG. 11, can also include, if desired, friction reduction means, such as oil, washers, and/or ball bearings, etc.

The above mentioned rotational force is controlled (dampened and limited) according to the preferred construction of the device. There are a number of ways that such a damping means can be formed according to the present invention.

For example, according to a first embodiment, as shown in FIG. 1, damping mechanism 80 includes a single tension spring 81 which is connected at one end to an adjustable support 82, FIG. 7, attached to the beam 3 of the floor frame 1 and connected at the other end to a chord 83, FIG. 10, extending around a pulley 84 attached to the front beam 12 of the center frame 10. As shown in FIG. 1, the chord 83 splits to a V-shape and each leg of the V-shape portion is connected to an opposite end portion of the track 20. As shown, the chord ends are connected at holes in the front side of the beam 26 of the pivoted support frame 21. In this manner, a single tension spring is provided which dampens the motion in both directions clockwise and counterclockwise around the central pivot axis.

Preferably, the tension varies such that it increases with added rotation from the neutral position (such as a straight downhill stance position) whereby it delineates how far the track will rotate before stopping for a given weight or pressure. As should be clearly understood, a higher tension decreases the extent of track rotation, and a lesser tension allows for an increase in track rotation.

In the preferred embodiment, the track is rotated through about 30 to 60 degrees from the initial transverse neutral position. The amount of rotation, as described above, depends on the spring tension, the user's weight, and the location of the track end stops. It will be recognized that greater or lesser angles of rotation could be utilized and still maintain the essence of the invention.

Figure 18:
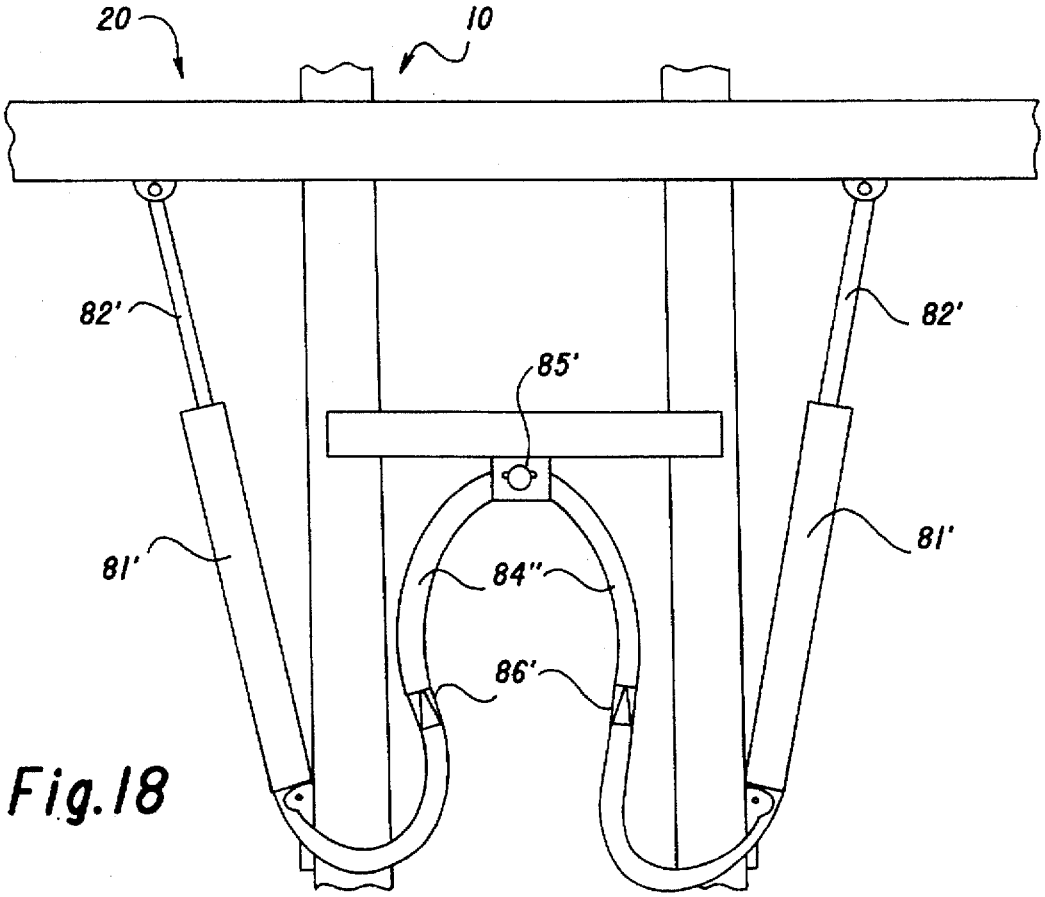
FIG. 18 is a top plan view of a damping mechanism according to another embodiment of the invention.

In a most preferred embodiment, a damping mechanism 80' of the type shown in FIG. 18 is employed. In the preferred construction of this latter damping mechanism, two separate damping cylinders 81' are used. As shown, the cylinders 81', preferably, have cylinder rods 82' extending therefrom and attached at opposite sides of the central pivot axis to the beam 26 of the pivoted support frame 21. The opposite ends of the cylinders 81' are preferably attached to the sides of the side beams 14 and 15 of the center frame 10 via brackets, as shown, or the like. In order to accommodate rotational movement of the track 20, the cylinders 81' and the cylinder rods 82' are pivotally connected to the side beams 14, 15 and beam 26 of track 20, respectively.

As discussed above, the cylinders 81' in the latter embodiment and the spring 81 in the former embodiment can serve the very important purposes of dampening and controlling the extent of rotation of the track.

Whether these embodiments are constructed so as to bias the track to a neutral position (i.e. a downhill stance) is not significant. In the most preferred embodiment, e.g. the latter discussed embodiment, the damping means does not bias the rotation of the track in one particular direction.

As illustrated in FIG. 18, in the preferred construction of the latter embodiment, the cylinders 81' are connected to a common 3-way valve 85'. The 3-way valve 85' allows the adjustment and escape of air from the cylinder which is being compressed due to the bias of weight by the user on the side of the track at which that cylinder is connected.

The 3-way valve 85' controls track rotation via the escape of air therethrough. The 3-way valve 85' provides connections between each of the two cylinders and an open port, via its adjustable valve. The cylinders 81' have means (e.g. valve means) to replenish the cylinders with air during an extension stroke. This means is incorporated into the cylinder and not shown.

This latter embodiment has substantial advantages. A first advantage is that the rate of compression is easily adjusted for both increasing and decreasing the dampening. In particular, this can be achieved in both cylinders equally, by simply further opening or closing the common 3-way valve 85'—the 3-way valve including an adjustment means, such as an incrementally rotatable portion, as would be readily understood by one skilled in the art.

A second advantage is that the sound of the air as it escapes from the open port in the valve 85' creates a sound effect similar to that made during skiing, e.g. a 'schussing' sound.

As further shown in FIG. 18, preferably, check valves, or 1-way valves, 86' are included so that air does not simply travel from the compressing cylinder to the extending cylinder and thereby inhibit the damping effect provided by the controlled release of air from the compressed cylinder.

Further, the extent of the rotation of the track is limited by the cylinders reaching the extent of their travel. Preferably, springs (not shown) are provided inside of the cylinders to soften the effect of the cylinders reaching their extent of travel. This should prevent the user from experiencing an undesirably hard or abrupt stop as the track reaches its extent of rotation. One skilled in the art should recognize that compression springs, tension springs, or other resilient means could be utilized.

Although the above construction is preferred, one skilled in the art should recognize that this preferred embodiment can be modified without departing from the spirit of the invention. For example, although the described embodiment is preferred, it should be recognized that other means to dampen with using escaping air could be used—e.g. either the escape of air during compression, extension, or a combination of both, could be utilized. Further, although less preferred, the cylinder(s) could be mounted differently and/or oriented differently and/or a different number of cylinders could be used.

As shown in FIG. 7, in the preferred embodiment, the center frame 10 is mounted on top of the floor frame 1 via rubber vibration mounts 50. In the preferred embodiment, as shown in FIGS. 1, 2 and 7, the side beams of the lower frame extend below the side beams of the center frame with the rubber vibration mounts therebetween. As shown in FIGS. 7 and 8, the mounts 50 are supported on the floor frame by retainer bolts 51 having nuts 51' attached at their ends and sized so as to be larger than the holes in the center frame into which the retainer bolts 51 penetrate. As shown in FIG. 7, retainer bolts 58, having a head portion (not shown) engaging the floor frame (e.g. at an inside surface of the upper sidewall 1T, FIG. 8), and nuts 58', engageable with the center frame (e.g. at an inside surface of the lower sidewall 10B, FIG. 8), are also provided so as to help to further prevent the rubber mounts from being subjected to tensile loads. As illustrated, retaining cylindrical members 52 which extend through holes 53 in the center frame 10 can also be provided. As shown in FIG. 8, in the preferred construction, through-holes 53' are included for providing access to bolts 51', etc. In this manner, bolts, etc., can be maintained within the frame structure and unexposed.

The provision of the rubber vibration mounts, or the like, between the floor frame and the center frame provides a number of substantial benefits. For example, the mounts enable a tilting and/or rocking motion of the center frame (primarily sideways in the present embodiment due to the narrower widthwise spacing of the mounts) and hence tilting and/or rocking motion of the track frame and foot platform assemblies—to some degree through 360 degrees.

This rocking of the track enables the outside foot platform to fall in a position below the inside platform, which is very similar to one's positioning when on a ski slope, FIG. 2.

The elasticity of the mounts also gives a sensation of standing on a softer surface, such as snow.

As the operator goes from one turn to another, e.g. shifts his weight from a turn to one side to a turn to the other side, the elasticity in the mounts also provides a modest sensation of springing or rebounding as would occur when skiing.

In the device of the present invention, skiing is approximated accurately. For example, the horizontal pivoting around the pivot rods 37, FIG. 5, of the foot platforms 30A and 30B allows for angulation and/or edging simulation and training, and the vertical pivot rods 36 extending below the foot platform support brackets 35 allows for foot steering (parallel, wedge, etc.) simulation and training. In the present invention, the two foot platforms are independently and freely moved laterally along the track and rotationally about pivot rods 36. Further, the foot platforms also move rotationally around the pivot axis x as the track is rotated around that axis. In addition, the horizontal pivot 37 for the platform is located above the foot platform to provide greater initial stability.

The rotation of the foot platforms individually about the generally vertical axes y through each pivot rod 36, shown in FIG. 5, also allows for the fore and aft positioning of the feet similar to that found in actual skiing. For example, rotation of the platforms in one direction results in the downhill weighed (outside) ski or foot to position behind the uphill (inside) ski or foot as in a natural and recommended skiing stance.

As illustrated in dotted lines in FIG. 5, in another embodiment, the present invention contemplates adding forward and/or rearward ski tips 39 and 39', respectively, to the foot platforms to aid in the visualizing of the position of the foot platforms about their vertical axis (parallel, wedge, or somewhere between), and to increase the realism of the device. Such ski tips could be attached to the foot platform support brackets 35. In addition, such ski tips could be attached to the pivoting foot support surfaces 31 (such as over the bracket 35, FIG. 6) so as to angle the ski tips along with the angle of the foot position.

Figure 9:
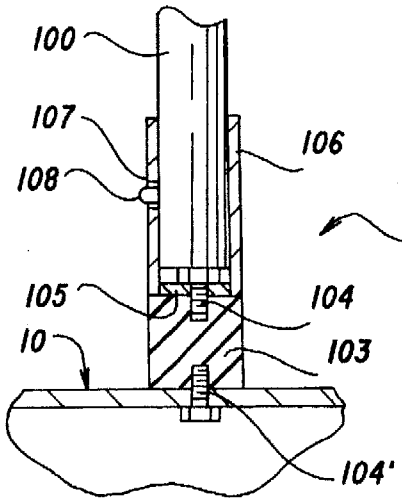
FIG. 9 is a side view, partly in section, of the connection between the attached ski poles and the center frame of the preferred embodiment shown in FIG. 1.

Poles 100, FIG. 1, having handles 101 at the upper end, are removably mounted to the center frame 10 via joints 102, FIGS. 1, 9 and 10, at the lowermost end. Such poles are adjustable in length and provide stability up or down and to some degree sideways at any angle. Preferably, the poles are attached to the center frame 10, FIG. 1, and among other things, provide a mounting point without building the base frame too large.

The length adjustability is accomplished, preferably, by making each of the poles from two, or more, telescoping members which are fixable at a plurality of locations, such as by spring biased pins which insert into corresponding support holes.

As best shown in FIG. 9, in the preferred embodiment, the joints 102 at the base of the poles each include: a pole receiving socket 106 having a lower wall 105 at the lower end thereof; a flexible member 103 made of a flexible material such as rubber or the like; the flexible member having a through-hole aligned with through holes in the wall 105 and in the upper surface of the beam 12; bolts 104 and 104' extending into and fixed to the flexible member 103 through respective said throughholes. The flexible members 103 can be attached at, or near, the base of the poles by other appropriate means, such as clamps, rivets, nails, adhesives, etc. Bolts 104 and 104' can also be arranged with head portions formed inside the flexible member 103 so as to be firmly attached therein and with the shank portions outwardly extending from the flexible member 103 and securable with nuts. In addition, a similar flexible mount as between the floor frame 1 and the center frame 10 can be utilized, such as is readily available commercial vibration mounts.

Further, the poles can also include a pin 108 which is extendable into a pin hole 107 in the side of the socket 106 for securing the pole therein. Thus, the poles can be flexibly pivotable about the flexible member 103. Preferably, the flexible portions have sufficient flexibility that the poles can easily lay flat against the ground or be positioned beneath the track 20 so as to fold to a compact storage state.

The present device is made with a limited number of parts. The beams of the floor frame, center frame, and track, etc., can be made hollow in form so as to reduce the weight of the device. In addition, respective parts are easily assembled and disassembled, e.g. the pivoting track easily fits on the center frame and the foot platforms easily fit onto the track, and the beams, etc., can be easily connected by bolts and nuts or the like. Thus, the device is easily disassembled for storage and easy replacement of parts.

Further, the few number of parts and well designed frame structure can enable the device to be made light weight and, thus, portable to facilitate transport of the device.

As also discussed, the assembled device can also be placed in a relatively flat state whereby it may be stored.

As discussed above, the device described enables a very accurate skiing simulation. To briefly describe one way of using the device, the user can first hold each of the hand poles while standing with feet straddling or next to the device; next the user places his feet on the foot platforms, possibly assisted by the use of a braking mechanism; and then, once standing on the device, the user simulates various aspects of skiing and skiing maneuvers. As an example, to simulate a turn to the right, such user can place the body weight on the left foot (i.e. the outside foot) while the left foot platform is located on the left side of the central pivot axis x. To simulate a turn to the left, the user could place the user's body weight on the right foot (i.e. the outside foot) while the right foot platform is located on the right side of the central pivot axis x. By placing body weight on one side of the central pivot axis, the track 20 tends to rotate, simulating a skiing turn.

There are many ways in which the present device can provide exercise and enable high accuracy ski simulation. As a result, there are many technique training possibilities available in the use of the instant device.

While the instant invention has been shown and described with specific reference to embodiments presently contemplated as the best mode of carrying out the invention in actual practice, it is understood that various changes may be made in adapting the invention to different embodiments without departing from the broader inventive concepts disclosed herein and comprehended by the claims which follow.

What is claimed is:

1. A skiing simulation device, comprising:

a support frame;

a track mounted on said support frame for rotation on said support frame about an inclined axis, said track including a channel and a pair of track cars mounted in said channel each having a friction reducing member for enabling each said track car to move freely along said channel; and a foot platform for a user's foot mounted on each track car and slidable with said track car along said channel independently of the other foot platform mounted on the other track car slidable along said channel.

2. The skiing simulation device according to claim 1, wherein said support frame is flexibly mounted on a floor frame.

3. The skiing simulation device according to claim 1, wherein said support frame includes a pivot around which said track is rotatable.

4. The skiing simulation device according to claim 1, wherein said foot platforms are each independently rotatable about a generally horizontal axis relative to said track.

5. The skiing simulation device according to claim 2, wherein said support frame is flexibly supported on said floor frame via flexible mounts.

6. The skiing simulation device according to claim 5, wherein said flexible mounts are rubber isolation mounts.

7. The skiing simulation device according to claim 1, wherein said channel is a receiving channel which surrounds and holds said track cars.

8. The skiing simulation device according to claim 1, wherein said friction reducing members are wheels.

9. The skiing simulation device according to claim 1, wherein said foot platforms are pivotally supported in a pivot bushing in said track cars, said foot platforms each having a pivot rod which extends into said pivot bushing.

10. The skiing simulation device according to claim 1, wherein said track cars include brakes.

11. The skiing simulation device according to claim 8, wherein said brakes are weight activated momentary type brakes.

12. The skiing simulation device according to claim 11, wherein said weight activated momentary type brakes include braking plates located beneath said foot platform for pushing downward to frictionally brake against a portion of said track.

13. The skiing simulation device according to claim 1, further including dampening means for controlling rotation of said track.

14. The skiing simulation device according to claim 13, wherein said dampening means includes at least one air cylinder connected between said support frame and said track.

15. The skiing simulation device according to claim 1, wherein adjustable track end stops are provided on said track for limiting the movement of said track cars.

16. The skiing simulation device according to claim 15, wherein said adjustable track end stops include means for creating a biasing force against said track cars when said track cars abut the track end stops.

17. The skiing simulation device according to claim 1, further including a pair of poles which are flexibly mounted to said support frame.

18. The skiing simulation device according to claim 1, wherein each said foot platform on each said track car is further independently rotatable about a generally vertical axis on said track.

19. The skiing simulation device according to claim 4, wherein said foot platforms are each further independently rotatable about a generally vertical axis on said track.

20. The skiing simulation device according to claim 4, wherein said generally horizontal axis is located above a foot support surface of each of said foot platforms.

21. The skiing simulation device according to claim 1, wherein said inclined axis is about 10 degrees forward.

* * * * *